United States Patent [19]

Starnes et al.

[11] Patent Number: 4,589,361

[45] Date of Patent: May 20, 1986

[54] APPARATUS AND METHOD FOR AUTOMATICALLY GUIDING, TRIMMING, SPLITTING AND SIDE HEMMING CONTINUOUS TEXTILE MATERIAL

[75] Inventors: Dennis L. Starnes; William G. Kimball; David K. Keziah, all of Kannapolis, N.C.

[73] Assignee: Cannon Mills Company, Kannapolis, N.C.

[21] Appl. No.: 656,040

[22] Filed: Sep. 28, 1984

[51] Int. Cl.[4] ..... D05B 97/00; D05B 21/00; D05B 35/02

[52] U.S. Cl. ..... 112/262.3; 112/121.11; 112/121.15; 112/141; 112/153; 112/305; 112/306

[58] Field of Search ..... 112/121.11, 121.12, 112/121.15, 141, 143, 153, 305, 306, 307, 262.3, 10, 11

[56] References Cited

U.S. PATENT DOCUMENTS

| | | | |
|---|---|---|---|
| 693,045 | 2/1902 | Millhiser et al. | 112/10 |
| 2,834,307 | 5/1958 | Jones et al. | 112/11 X |
| 2,910,122 | 10/1959 | Anderson et al. . | |
| 3,073,197 | 1/1963 | Gowin . | |
| 3,119,535 | 1/1964 | Hoffman . | |
| 3,244,418 | 4/1966 | Henderson . | |
| 3,417,645 | 12/1968 | Brock . | |
| 3,436,002 | 4/1969 | Racine . | |
| 3,664,223 | 5/1972 | Brocklehurst . | |
| 3,719,114 | 3/1973 | Vischulis . | |
| 3,869,997 | 3/1975 | German | 112/121.12 |
| 3,908,881 | 9/1975 | McCann . | |
| 4,212,419 | 7/1980 | Huber . | |
| 4,358,978 | 11/1982 | Lawson . | |
| 4,407,439 | 10/1983 | Buss . | |

*Primary Examiner*—H. Hampton Hunter

*Attorney, Agent, or Firm*—Bell, Seltzer, Park & Gibson

[57] ABSTRACT

An apparatus and method is provided for automatically guiding, trimming, splitting and side hemming continuous textile material having thickened individual portions, such as terry towels, woven therein in side-by-side relationship transversely of the material and in series longitudinally of the material. This material is fed through the apparatus and thinned selvage edge portions are trimmed to a predetermined width, hems are formed in each of the trimmed selvage edges and stitched with mechanisms in a first work station of the apparatus. The trimming, folding and stitching mechanisms on each side of the traveling material are individually moved and aligned in proper transverse positions relative to each of the selvage edges regardless of transverse deviation in the longitudinal paths of travel of the selvage edges as the material travels through the first work station. Thereafter, the material is longitudinally split through a thinned middle portion into strips, hems are formed in the longitudinally-extending cut side edges of the strips and the folded hems are stitched with mechanisms in a second work station in the apparatus. The thinned middle portion of the traveling material is aligned relative to the splitting, folding and stitching mechanisms prior to such operations in the second work station for splitting the material generally through the center of the thinned middle portion and forming uniform stitched hems on each cut edge.

37 Claims, 12 Drawing Figures

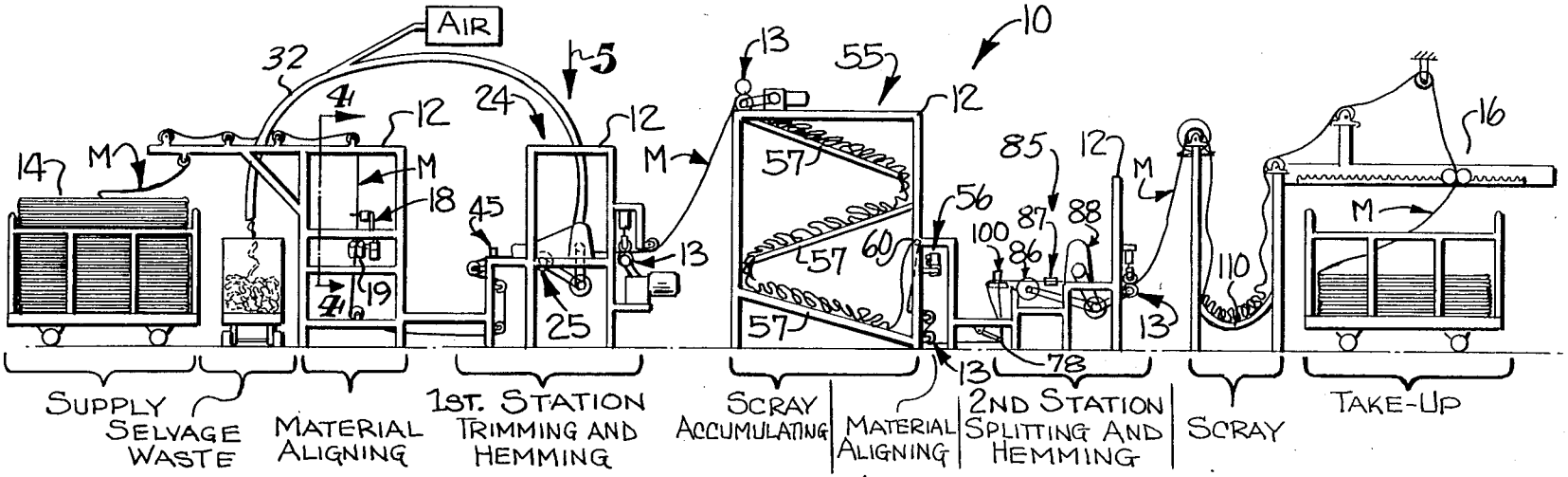
FIG-1
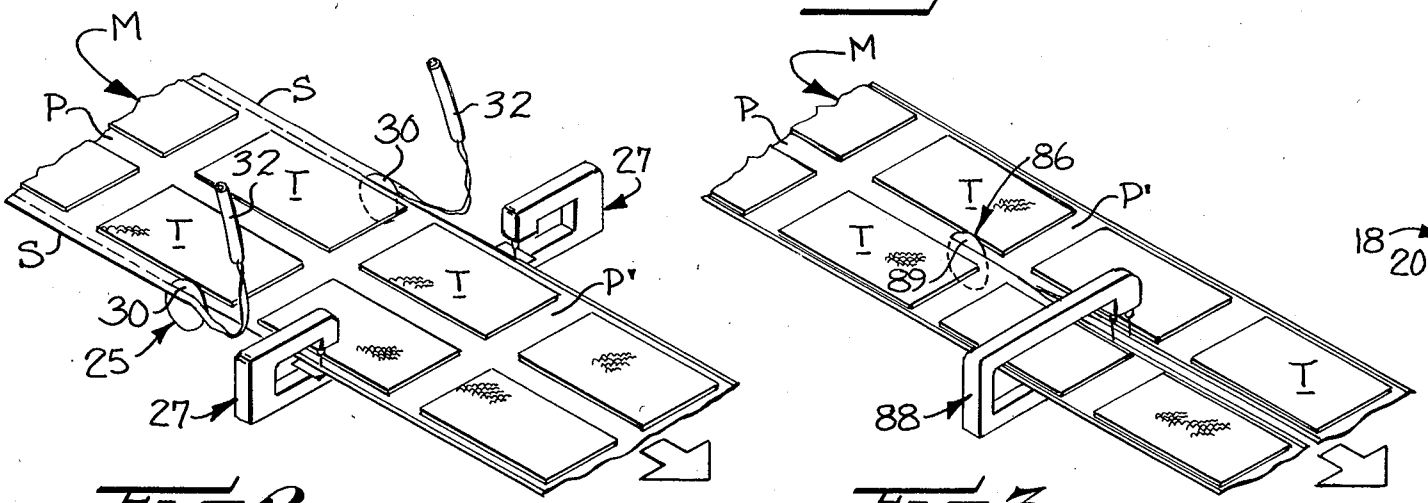
FIG-2
FIG-3
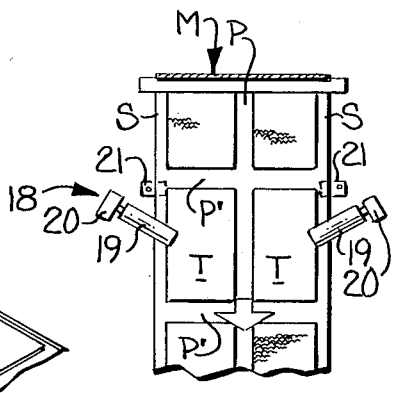
FIG-4

AIR SOURCE
V
T
M
S
27
26
25
30
31
35
37
38
40
41
42
43
45
46
47
48
49
50
51
52

APPARATUS AND METHOD FOR AUTOMATICALLY GUIDING, TRIMMING, SPLITTING AND SIDE HEMMING CONTINUOUS TEXTILE MATERIAL

FIELD OF THE INVENTION

This invention relates to an apparatus and method for automatically guiding, trimming, splitting and side hemming continuous textile material having thickened individual portions, such as terry towels, woven therein in side-by-side relationship transversely of the material and in series longitudinally of the material and being separated by a thinned portion extending longitudinally along generally the middle of the material and having thinned selvage edge portions extending along each longitudinal side edge of the material.

BACKGROUND OF THE INVENTION

In a number of textile operations, continuous textile material is produced having thickened individual portions woven therein in side-by-side relationship transversely of the material and in series longitudinally of the material and which are separated by a thinned portion extending longitudinally along generally the middle of the material and having thinned selvage edge portions extending along each longitudinal side edge of the material. This is particularly true in textile operations for producing terry towels in which the thickened portions are individual terry towels.

In the fabrication of individual articles, such as terry towels, from such woven textile material, the individual articles must be cut from the continuous length of textile material, along the longitudinally-extending thinned portion and along the transversely-extending thinned portions. In the case of terry towels and other articles, the originally woven selvage edges must be trimmed, folded into a hem and stitched and the cut edges must also be folded into hems and stitched to form desired end products.

Heretofore, these fabrication operations have been performed, for the most part, manually by an operator in separate trimming, splitting and hemming operations utilizing separate cutting, hem folding and stitching machines. As can be appreciated, these are time consuming, labor absorbing and expensive fabricating operations. While some automatic and semiautomatic machines have been proposed for increasing efficiency of these operations, these semiautomatic or automatic machines have not been commercially successful for many reasons including the inability to properly compensate for transverse movement of the continuous textile material when traveling through such semiautomatic or automatic machines so as to provide uniform stitched hems on all edges of the fabricated products.

OBJECT AND SUMMARY OF THE INVENTION

Accordingly, it is the object of this invention to provide an apparatus and method for automatically guiding, trimming, splitting and side hemming continuous textile material having thickened individual portions, such as terry towels, woven therein in side-by-side relationship transversely of the material and in series longitudinally of the material and being separated by a thinned portion extending longitudinally along generally the middle of the material and having thinned selvage edge portions extending along each longitudinal side edge of the material, which apparatus and method overcome the problems discussed above and which provide a commercially satisfactory automatic apparatus and method.

By this invention, it has been found that the above object may be accomplished by a method and apparatus briefly described, as follows.

The continuous textile material is fed from a supply through an automatically operating apparatus. Each of the selvage edge portions of the traveling web is trimmed to a predetermined width, hems are folded in each trimmed selvage edge and the folded hems are stitched with mechanisms in a first work station of the apparatus while the material is fed through the first work station in the apparatus. These trimming, folding and stitching mechanisms on each side of the traveling material are individually moved and aligned in proper transverse positions relative to each of the selvage edges regardless of transverse deviation in the longitudinal paths of travel of the selvage edges as the material travels through the first work station.

Thereafter, the material is longitudinally split through the thinned middle portion into strips, hems are folded in the thus formed longitudinally-extending cut side edges of the strips and the folded hems are stitched with mechanisms in a second work station in the apparatus. The thinned middle portion of the traveling material is aligned relative to the splitting, folding and stitching mechanisms prior to such operations in the second work station for splitting the material generally through the center of the thinned middle portion and forming uniform stitched hems on each cut edge.

As a result of the above generally described method and apparatus of this invention, two strips of textile material will be formed which have uniformly trimmed, folded and stitched hems along each longitudinal edge thereof and which has been fabricated in an apparatus for automatically performing such fabrication operations without the necessity of a plurality of operators or separate machines.

These strips are then ready to be cut transversely to separate each individual article and the individual articles are hemmed along their transverse cut edges. These latter fabrication operations do not form a part of the apparatus or method of this invention and may be automatically performed in a further apparatus which may be a continuation of the present apparatus or utilized as a separate apparatus.

BRIEF DESCRIPTION OF THE DRAWINGS

Some of the objects and advantages of this invention having been stated, other objects and advantages will appear as the detailed description of a preferred embodiment of this invention is given in conjunction with the accompanying drawings, in which:

FIG. 1 is a schematic, side elevational view of a preferred embodiment of the apparatus of this invention;

FIG. 2 is a schematic, perspective view illustrating the textile material as it passes through a First Work Station of the apparatus of FIG. 1;

FIG. 3 is a perspective, schematic view of the textile material as it passes through a Second Work Station of the apparatus of FIG. 1;

FIG. 4 is an elevational view of the textile material as it passes through the aligning mechanism positioned prior to the First Work Station and taken generally along the line 4—4 of FIG. 1;

DETAILED DESCRIPTION OF A PREFERRED EMBODIMENT OF THIS INVENTION

Figure 5:
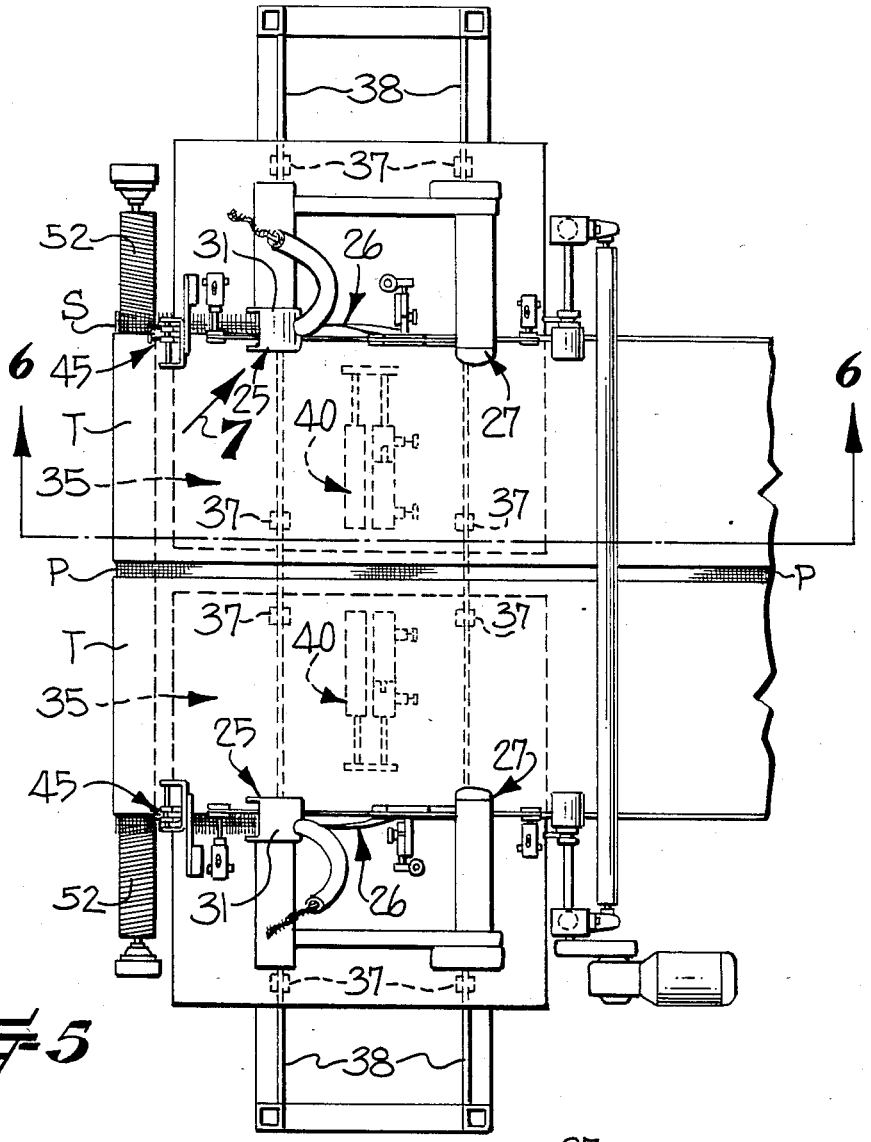
FIG. 5 is a top plan view of the mechanisms contained in the First Work Station of the apparatus of FIG. 1 and taken generally in the direction of the arrow 5 of FIG. 1.
Figure 6:
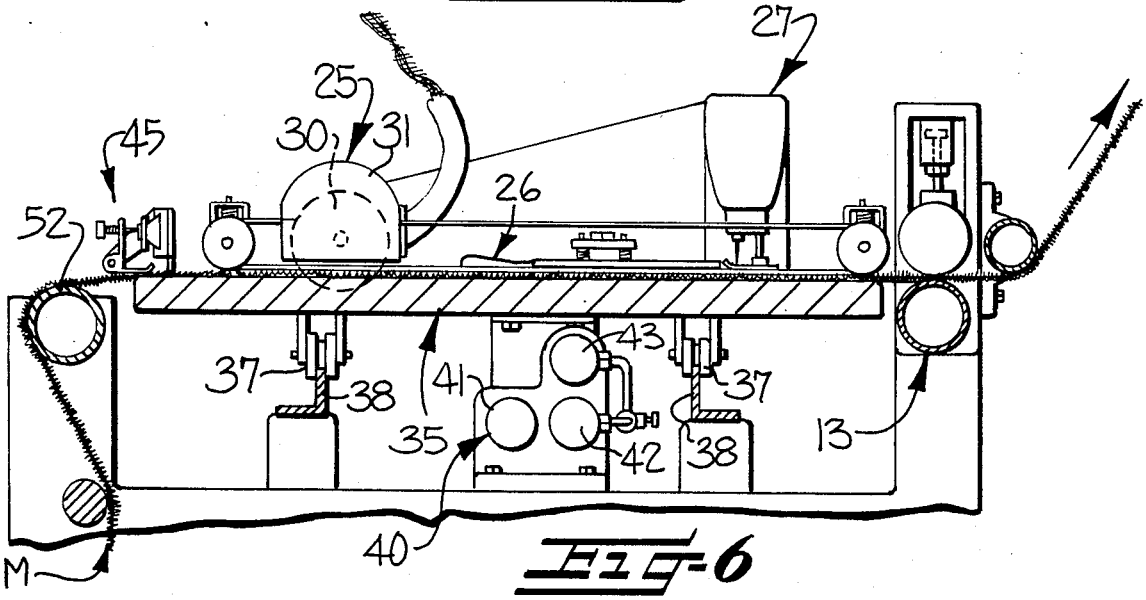
FIG. 6 is a sectional view taken generally along the line 6—6 of FIG. 5.
Figures 7, 8:
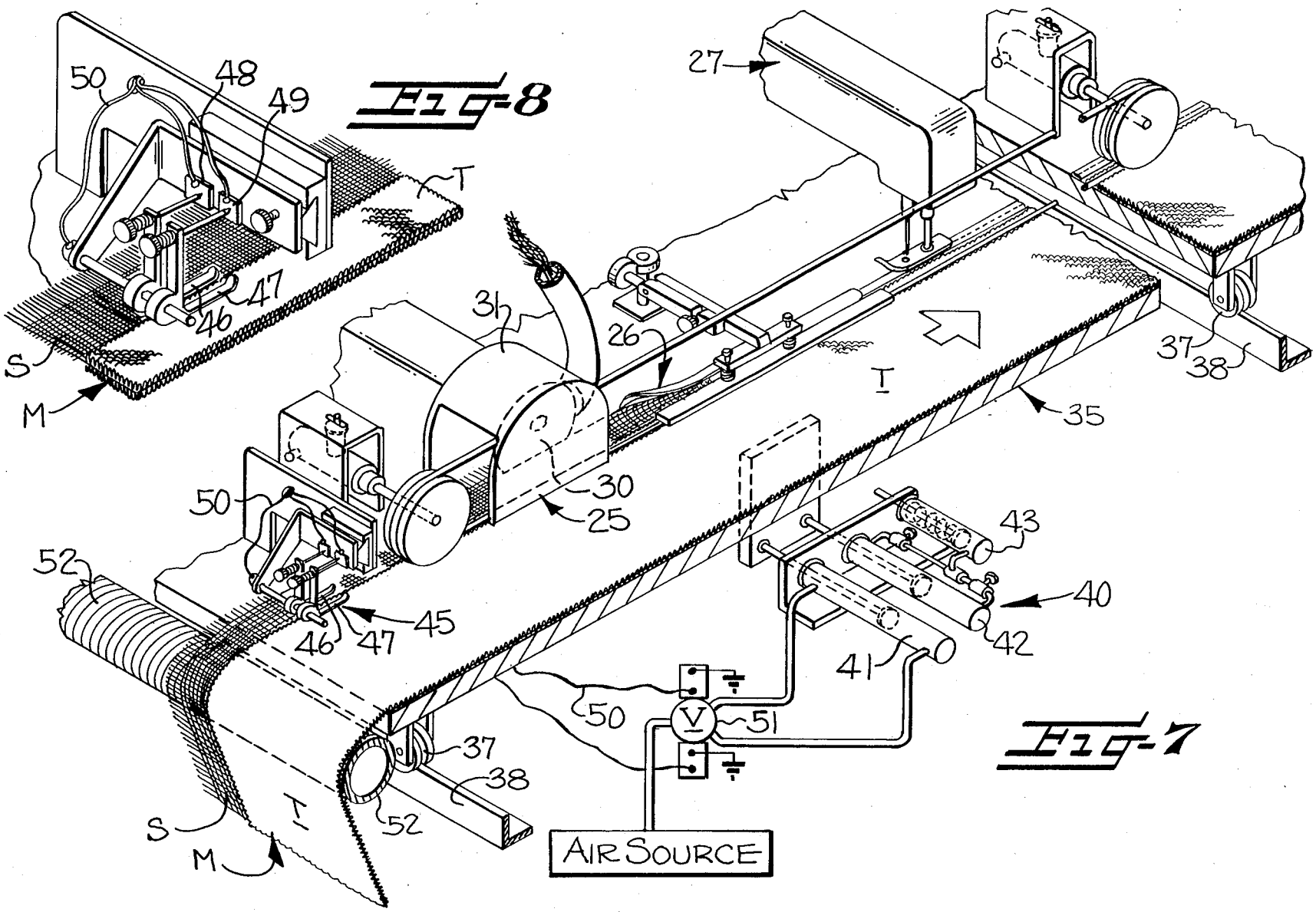
FIG. 7 is a perspective view of the mechanisms positioned on one longitudinal side of the textile material in the First Work Station and taken generally in the direction of the arrow 7 in FIG. 5.
FIG. 8 is an enlarged perspective detail of the sensing mechanisms utilized in the First Work Station of the apparatus.

Referring now to the drawings, there is illustrated therein a preferred embodiment of apparatus in accordance with this invention, generally indicated at 10, for automatically guiding, trimming, splitting and side hemming continuous textile material M having thickened individual portions T woven therein side-by-side relationship transversely of the material M and in series longitudinally of the material M and being separated by a thinned portion P extending longitudinally along generally the middle of the material M and having thinned selvage edge portions S extending along each longitudinal side edge of the material. The thickened individual portions T are also separated by transversely extending thinned portions P'. As illustrated in the drawings and as described hereinafter, the thickened portions T are woven terry towels and the thinned portions P are non-terry portions. However, it is to be understood that the invention is applicable to other products.

The apparatus 10 of this invention is illustrated schematically in its entirety in FIG. 1 and details of various portions of the apparatus are illustrated in the remaining Figures of the drawings. These remaining Figures are also somewhat schematic for simplicity and clarity of illustration and they do not illustrate all of the mechanism and devices contained in the apparatus 10. However, the Figures of the drawings do illustrate all of the features considered to be important in the method and apparatus of this invention and the remaining unillustrated devices are conventional and well understood by those with ordinary skill in the art.

The apparatus 10 includes firstly a frame means, collectively indicated by the reference numeral 12, for carrying the various mechanisms and devices contained in the apparatus 12, to be described below. The collective frame components constituting the frame means 12 may be interconnected and/or separated at the various positions along the apparatus 10, as desired.

The apparatus further includes feeding means, collectively indicated at 13, for feeding the continuous textile material M from a supply 14 through the apparatus 10 in a generally longitudinally-extending path of travel to a take-up 16, as shown generally in FIG. 1. These feeding means 13 may be conventional, driven feed rolls and/or other feeding mechanisms all of which are well known to those with ordinary skill in the art.

From the supply 14, the material M is fed by the feeding means 13 through a material aligning means 18 (FIGS. 1 and 4) for aligning the traveling material M in a desired longitudinal path of travel for presentation to fabrication mechanisms to be described below. This aligning means 18 may comprise pairs of angularly positioned guide rolls 19 through which each of the respective selvage edges S of the material M passes for guiding each such selvage edge transversely outwardly. The rolls 19 are connected to suitable piston and cylinder mechanisms 20 for moving the rolls into and out of contact with the selvage edges S of the material M in response to sensors 21 which sense the position of such selvage edges S in their longitudinal path of travel. These aligning means 18 may be commercially purchased from a number of sources and further details of the construction and operation thereof are well understood by those with ordinary skill in the art and does not require further explanation here.

From the aligning means 18, the material M is fed by the feeding means 13 to a first fabricating work station, generally indicated at 24, having respective separate movable means 25, 26, 27 positioned on each side of the traveling material M for respectively trimming each of the selvage portions S to a predetermined width, folding hems in each of the trimmed selvage edges S and stitching each of the folded hems in the selvage edges S as the material is fed through the first work station 24 (FIG. 1, 2 and 5–8).

Specifically, each of the trimming means 25 may comprise a rotatably driven circular blade 30 contained in a suitable housing 31 for trimming a predetermined excess amount of each of the selvages S from the material M. Suitable suction means 32 may be connected to each of the housings 31 for removal of the trimmed-off excess selvage S for carrying such trimmed-off excess selvage S to a selvage waste collection (FIG. 1).

The means 26 for folding hems in each of the trimmed selvages S of the material M as it travels through the first work station 24 may be any suitable hem folding device, such as the folding shoe illustrated in the drawings. Each of the stitching means 27 may be any sort of suitable single needle sewing malchine, as illustrated in the drawings.

The first work station 24 further includes separate carriage means 35, preferably in the form of generally horizontally-positioned table-like devices extending from beneath the traveling material M on respective sides of the thinned middle portion P and outwardly of the thinned selvage edge portions S and being movably mounted by rollers 37 on rails 38 carried by the frame means 12. These carriage means 35 respectively carry the trimming, folding and stitching means 25, 26, 27 for individual movement thereof transversely of the traveling material M.

Separate means 40, preferably in the form of fluid-operated double-acting piston and cylinder mechanisms, are respectively connected to the carriage means 35 for moving the respective carriage means 35 back and forth transversely of the traveling material M. The piston and cylinder mechanisms of the carriage moving means 40 may include a pneumatically-operated piston and cylinder 41 and hydraulically-separated piston and cylinder mechanisms 42 and 43 for dampening and slowing down the back and forth movement of the carriage means 35 by the pneumatic piston and cylinder mechanism 41.

Separate sensing and control means 45 are mounted on the frame means 12 and are respectively connected with the carriage moving means 40, specifically with the pneumatically-operated piston and cylinder mechanism 41, for individually sensing the respective longitudinal paths of travel of the thinned selvage portions S of the material M and controlling movement of said respective carriage means 35 for aligning the trimming, folding and stitching means 25, 26, 27 on each side of the traveling material M in proper transverse position relative to each of the respective selvage edges S regardless of transverse deviation of the longitudinal paths of travel of such selvage edges S as the material M travels through the first work station 24 of the apparatus 10.

These sensing and control means 45 comprise separate movable finger-like sensors 46, 47 positioned for pivotal movement in generally side-by-side relationship, so that the sensor 46 rides on the thinned selvage edge portion S and the sensor 47 rides on the adjacent thickened portion T at generally the juncture of such portions P, T in the desired path of travel of the material M. Electrical switches 48, 49 are respectively associated with each of the sensors 46, 47 for being actuated by the respective sensors 46, 47 when the respective sensors 46, 47 are moved by transverse deviation in the path of travel of the material M causing either the sensor 46 to move and ride on the thickened portion I or the sensor 47 to move and ride on the thinned selvage edge portion S of the material M. A suitable electrical circuit means 50 is connected between the electrical switches and the carriage moving means 40, specifically to a suitable solenoid-operated valve 51 controlling operation of the pneumatic piston and cylinder mechanism 41, for controlling operation of the carriage moving means 40 in response to movement of the sensors 46, 47 and actuation of the electrical switches 48, 49.

The first work station 24 may also include an aligning roll 52 which has outwardly-extending spiral grooves on each side thereof for cooperating with the aligning means 18 to pre-align the material M for proper longitudinal travel through the first work station 24.

Figure 9:
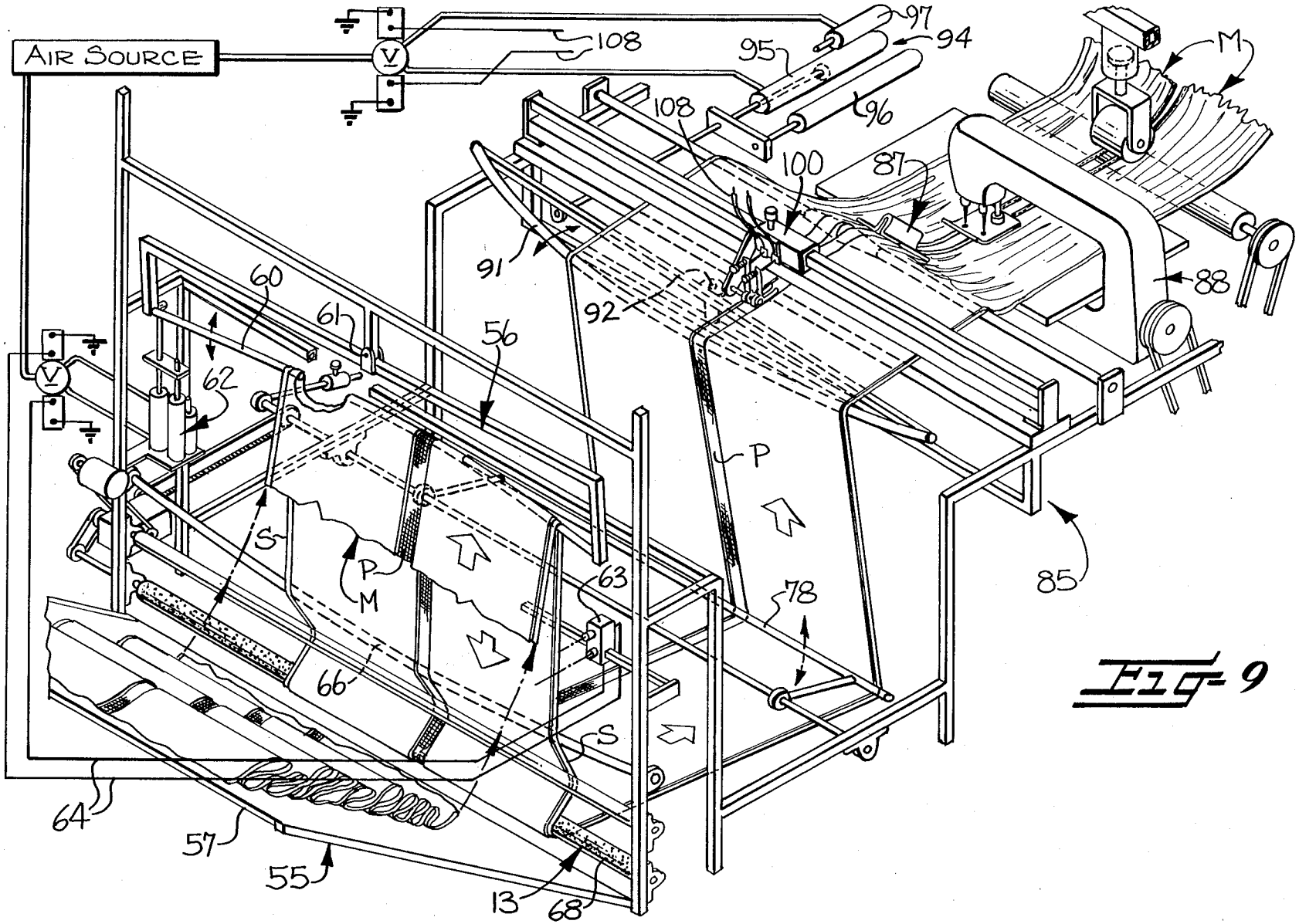
FIG. 9 is a perspective view of the mechanisms contained in the accumulating device, pre-aligning mechanism and Second Work Station of the apparatus.
Figure 10:
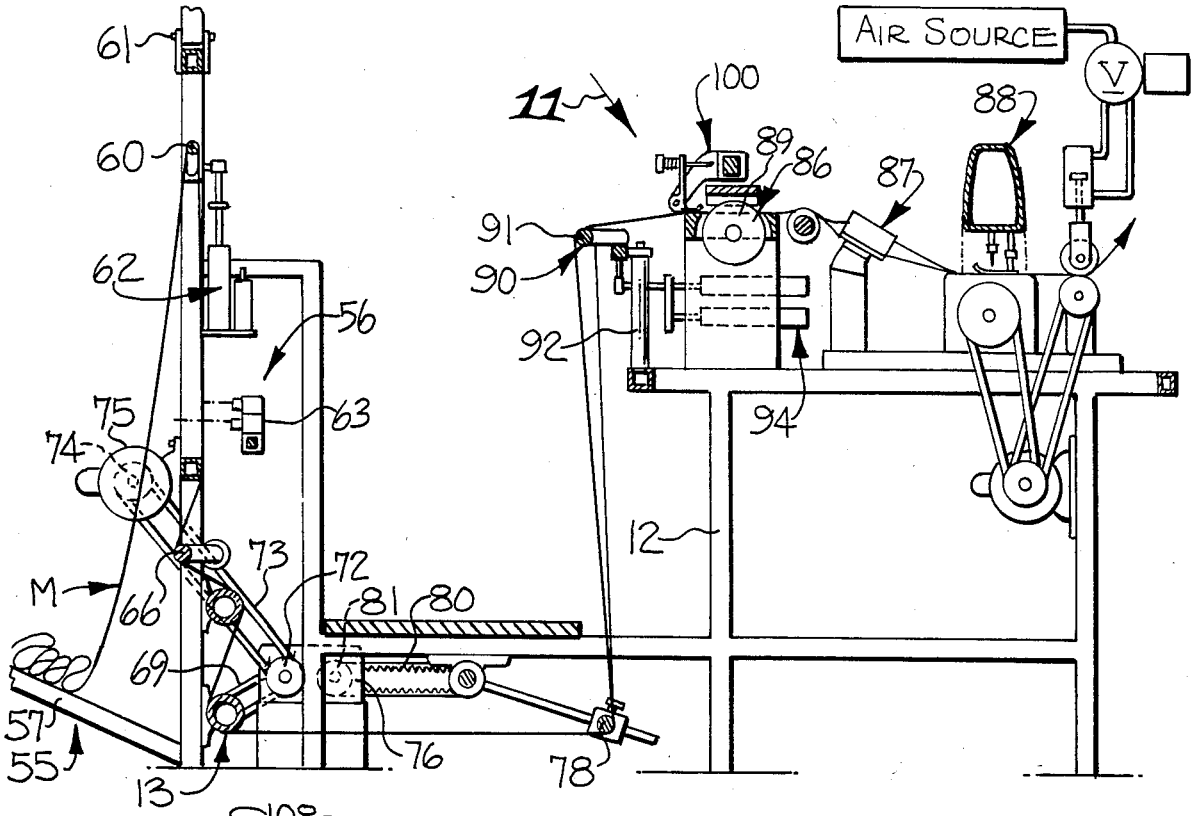
FIG. 10 is a side elevational view, with portions in section, of the mechanisms shown in FIG. 9.
Figure 11:
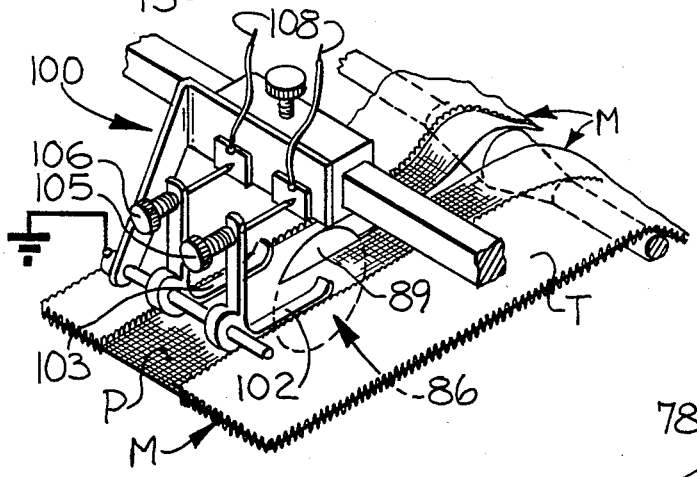
FIG. 11 is an enlarged perspective detail, taken generally in the direction of the arrow 11 of FIG. 10.

The material M, after the selvage edges S have been trimmed and hemmed in the first work station 24, is fed by the feeding means 13 forward in the apparatus 10 and into an accumulating means 55 for accumulating the traveling material M in a generally tensionless condition and then through an aligning means 56 for aligning the traveling material M in the desired longitudinal path of travel (FIGS. 1, 9 and 10). With this accumulating means 55 and aligning means 56, the material M is fed forwardly therefrom without excess tension and in a generally pre-aligned path of travel for further fabrication, as will be discussed below.

The accumulating means 55 may preferably comprise a generally vertically-oriented sinuous chute 57 for receiving the traveling material M at one end thereof and accumulating the traveling material M therein prior to removal therefrom at the other end thereof as the material is fed by the feeding means. For accumulating the material M in the sinuous chute 57, the material M would be fed by the feeding means 13 therein at a faster rate than it would be removed by the feeding means 13 therefrom.

The aligning means 56 preferably comprises a bowed guide rod 60 defining an outside convex surface (FIG. 9) and being pivotally mounted at 61 on the frame means 12 for receiving the traveling material M over the convex surface and for being moved about its pivot 61 generally in the longitudinal direction of the traveling material M to cause the traveling material M to move transversely. A fluid-operated double-acting piston and cylinder mechanism 62, constructed generally similar to the piston and cylinder mechanism 40, is carried by the frame means 12 and connected to the bowed guide rod 60 for pivotally moving the bowed guide rod 60 back and forth to transversely align the material M as it travels in its longitudinal path of travel. Photo-electric sensing means 63 are carried by the frame means 12 and positioned for sensing one longitudinal hemmed selvage edge S of the traveling material M. Suitable electrical circuit means 64 ar connected between the piston and cylinder mechanisms 62 and the photoelectric sensing means 63 for controlling operation of the piston and cylinder mechanism 62 in response to the position of the hemmed selvage edge S of the traveling material M as sensed by said photo-electric means 63 for controlling movement of the bowed guide rod 60. The aligning means 56 further includes a stationary bowed guide rod 66 for aiding in aligning the traveling material M.

Figure 12:
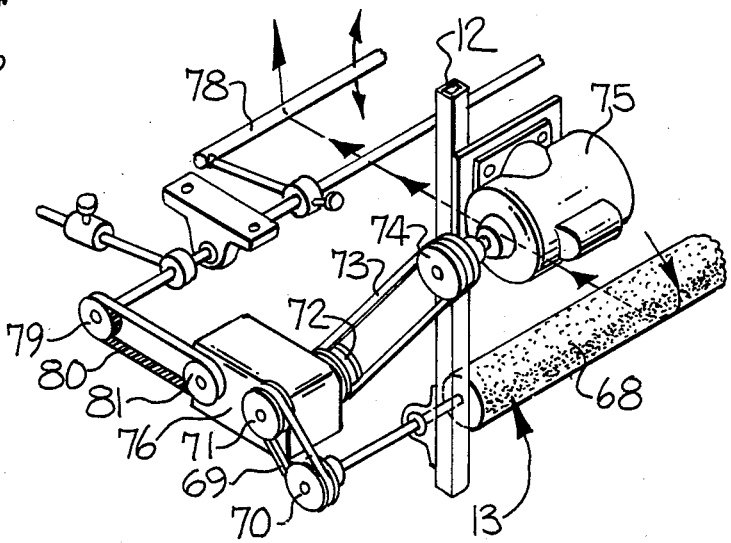
FIG. 12 is an enlarged perspective detail of the drive mechanism for the feed roll at the bottom of the pre-aligning mechanism and prior to the Second Work Station of the apparatus.

From the stationary bowed guide rod 66, the material M passes through one of the feeding means 13 (FIGS. 1, 9, 10, 12) which cooperates with the accumulating means 55 to eliminate excess tension in the traveling material M as it is fed to further fabricating mechanisms, to be described below. This feeding means 13, may comprise (FIG. 12) a driven feed roll 68 which is driven by suitable belts and pulleys 69–74 by a suitable electric motor 75 through a gear reduction unit 76. The gear reduction unit, which is commercially available, is controlled by a pivotally mounted rod 78 which acts on pulleys and belt 79–81 to control the gear reduction unit such that, if excessive tension is present on the material M as it passes under the rod 78, the rod 78 will pivot upwardly to change the gear reduction in the unit 76 to speed up the feed of the material M by the feed roll 68, and vice versa.

From the accumulating means 55 and the aligning means 56, the traveling material M passes in a pre-aligned path of travel without excess tension into a second fabricating work station 85 (FIGS. 1 and 9–11) which includes means 86, 87, 88 carried in stationary positions by the frame means 12 for longitudinally splitting the material M through the thinned middle portion P into separate strips of material M, folding hems in the thus formed longitudinally extending cut side edges of the thinned middle portion P of each of the strips of material M and stitching each of such folded hems. The means 86 for longitudinally splitting the material M through the thinned middle portion P into strips may comprise a driven rotary cutter 89, the means 87 for folding hems in the cut edges may comprise any conventional folding shoes and the means 88 for stitching the thus formed hems may preferably comprise a double-needle sewing machine.

The second work station 85 further includes means 90 carried by the frame means 12 for aligning the thinned middle portion P of the traveling material M relative to the stationary splitting, folding and stitching means 86, 87, 88 for splitting the material M generally through the center of the thinned middle portion P and forming uniformed stitched hems on each resulting cut edge of the thinned middle portion P of the material M.

This aligning means 90 is preferably in the form of a bowed guide rod 91 positioned in advance of the splitting, folding and stitching means 86, 87, 88 and defining an outside convex surface and being pivotally mounted at 92 on the frame means 12 for receiving the traveling material M over the convex surface and for being moved about its pivot 92 in generally the longitudinal direction of the traveling material M to cause the traveling material M to move transversely for alignment thereof in the longitudinal path of travel of the material M.

Means 94, preferably in the form of fluid-operated double-acting piston and cylinder mechanisms are respectively connected to the bowed guide rod 91 for moving the bowed guide rod 91 back and forth. The piston and cylinder mechanisms of this bowed guide rod moving means 94 may be of the same type as the piston and cylinder mechanism 40 described above including a pneumatically-operated piston and cylinder 95 and hydraulically-operated piston and cylinder mechanisms 96, 97 for dampening and slowing down the back and forth movement of the bowed guide rod 91 by the pneumatic piston and cylinder mechanism 95.

Sensing and control means 100 are mounted on the frame means 12 and are connected with the bowed guide rod moving means 94, specifically with the pneumatically-operated piston and cylinder 95, for sensing the longitudinal path of travel of the thinned middle portion P of the material M and controlling movement of the bowed guide rod 91 for aligning the thinned middle portion P of the material M with respect to the splitting, hemming and stitching means 86, 87, 88.

These sensing and control means 100 preferably comprise separate movable finger-like sensors 102, 103 positioned for pivotal movement in generally side-by-side relationship so that the sensors ride on the thinned middle portion P generally at the junctures thereof with the thickened portions T in the desired path of travel of the material M. Electrical switches 105, 106 are respectively associated with each of the sensors 102, 103 for being actuated by the respective sensors 102, 103 when the respective sensors 102, 103 are moved by transverse deviation in the path of travel of the thinned middle portion P of the material M causing either of the sensors 102, 103 to move and ride on the adjacent thickened portion T of the traveling material M. A suitable electrical circuit 108 is connected between the electrical switches 105, 106 and the piston and cyclinder moving means 94 in the same general arrangement as described above with respect to the electrical circuit 50 for controlling the piston and cyclinder moving mechanism 40 in the first work station 24 for controlling operation of the bowed guide rod moving means 94 in response to movement of the sensors 102, 103 and actuation of the electrical switches 105, 106.

From the second fabricating work station 85, the individual strips of material M with hemmed side edges on both sides of each strip are fed forwardly by the feeding means 13 into a scray accumulating mechanism 110 and then to take-up 16. The take-up 16 may stack the individual strips of material M with hemmed side edges for transportation to a separate machine for cutting apart the individual thickened portions or towels T for end hemming of each individual separated thickened portion or towel T in a separate apparatus or the strips of material M may be fed directly to such additional apparatus, as described. This additional apparatus does not form a part of the present invention and will not be described herein.

As may be seen from the above description of a preferred embodiment of apparatus 10 of this invention, material M is fed from a supply 14 through an automatically operating apparatus 10. Each of the thinned selvage edge portions S of the traveling material M are trimmed to a predetermined width, hems are folded in each of the trimmed selvage edges S and each of the folded hems are stitched with mechanisms 25, 26, 27 in a first fabricating work station 24 of the apparatus 10 while the material M is fed through the first work station 24 in the apparatus 10. The mechanisms for trimming, folding and stitching on each side of the traveling material M in the first work station are individually moved and aligned in propeer transverse positions relative to each of the thinned selvage edges S regardless of transverse deviations in the longitudinal paths of travel of such selvage edges S as the material M travels through the first work station 24 of the apparatus 10. The material M is then longitudinally split through the thinned middle portion P into strips, hems are folded in the thus formed longitudinally-extending cut side edges of the strips of material M and each of the folded hems are stitched with mechanisms 86, 87, 88 in a second work station 85 of the apparatus 10. The thinned middle portion P of the traveling material M is aligned relative to the splitting, folding and stitching mechanisms 86, 87, 88 for splitting of the material M generally through the center of the thinned middle portion P and forming uniform stitched hems on each cut edge of the thinned middle portion P as the material M travels through the second work station 85.

Preferably, the traveling material is pre-aligned in advance of the travel thereof through the first work station 24 for aiding in individually moving and aligning the mechanisms 25, 26, 27 for trimming, folding and stitching on each selvage edge S of the traveling material M. Also, it is preferable to accumulate the traveling material M in a generally tensionless condition and align the traveling material M in a desired longitudinal path of travel as the material M travels between the first and second work stations 24, 85 and prior to aligning the thinned middle portion P of the traveling material M relative to the splitting, folding and stitching mechanisms 86, 87, 88 in the second work station.

Accordingly, a method and apparatus have been provided by this invention for automatically guiding, trimming, splitting and side hemming continuous textile material having thickened individual portions T, such as terry towels, woven therein side-by-side relationship transversely of the material and in series longitudinally of the material and being separated by a thinned portion extending longitudinally along generally the middle of the material and having thinned selvage edge portions S extending along each longitudinal side edge of the material M, which apparatus and method overcome the problems discussed above and which provide a commercially satisfactory automatic apparatus and method.

In the above described drawings and the detailed description set forth above there has been set forth a preferred embodiment of this invention and, although specific terms are employed, they are used in a generic and descriptive sense only and not for purposes of limitation.

What is claimed is:

1. Apparatus for automatically guiding, trimming, splitting and side hemming continuous textile material, having thickened individual portions, such as terry towels, woven therein in side-by-side relationship transversely of the material and in series longitudinally of the material and being separated by a thinned portion extending longitudinally along generally the middle of the material and having thinned selvage edge portions extending along each longitudinal side edge of the material; said apparatus comprising:

frame means;

means carried by said frame means for feeding the continuous textile material from a supply through said apparatus in a generally longitudinally-extending path of travel;

a first work station having movable means positioned on each side of the traveling material for trimming each of the selvage edge portions to a predetermined width, folding hems in each of the trimmed selvage edges and stitching each of the folded hems as the material is fed through said first work station, and means mounted on said frame means and carrying said trimming, folding and stitching means for individually moving and aligning said trimming, folding and stitching means on each side of the traveling material in proper transverse position relative to each of the respective selvage edges regardless of transverse deviation of the longitudinal paths of travel of such selvage edges as the material travels through said first work station; and a second work station positioned subsequent to said first work station in the path of travel of the material and having stationary means carried by said frame means for longitudinally splitting the material through the thinned middle portion into strips, folding hems in the thus formed longitudinally-extending cut side edges of the strips and stitching each of the folded hems, and means carried by said frame means for aligning the thinned middle portion of the traveling material relative to said stationary splitting, folding and stitching means for splitting the material through generally the center of the thinned middle portion and forming uniform stitched hems on each cut edge.

2. Apparatus, as set forth in claim 1, in which said means for individually moving and aligning said trimming, folding and stitching means in said first work station includes separate carriage means movably mounted on said frame means on respective sides of the traveling material and respectively carrying said trimming, folding and stitching means for individual movement transversely of the traveling material.

3. Apparatus, as set forth in claim 2, in which each of said carriage means comprises a generally horizontally-positioned tablelike device extending from beneath the traveling material on respective sides of the thinned middle portion and outwardly of the thinned selvage edge portions for carrying said trimming, folding and stitching means on the outwardly extending part thereof.

4. Apparatus, as set forth in claim 2, in which said means for individually moving and aligning said trimming, folding and stitching means in said first work station further includes separate means carried by said frame means and respectively connected to said carriage means for moving said carriage means back and forth transversely of the traveling material, and separate sensing and control means mounted on said frame means and respectively connected with said means for moving said carriage means for individually sensing the respective longitudinal paths of travel of the thinned selvage edges of the material and controlling movement of said respective carriage means.

5. Apparatus, as set forth in claim 4, in which each of said means for moving said carriage means comprises fluid-operated double-acting piston and cylinder mechanisms.

6. Apparatus, as set forth in claim 4 or 5, in which each of said sensing and control means comprises separate movable finger-like sensors positioned in generally side-by-side relationship for respectfully riding on the thinned selvage edge portion and on the adjacent thickened terry portion at generally the juncture between such portions in the desired path of travel of the material, an electrical switch associated with each of said sensors for being actuated by said respective sensor when said respective sensor is moved by transverse deviation in the path of travel of the material causing the respective sensor to ride on the other of such portions of the material, and electrical circuit means connected between said electrical switches and said carriage moving means for controlling operation of said carriage moving means in response to movement of said sensors and actuation of said electrical switches.

7. Apparatus, as set forth in claim 1, in which said means for aligning the thinned middle portion of the moving material in said second work station includes a bowed guide rod means defining an outside convex surface and being pivotally mounted on said frame means for receiving the traveling material over said convex surface and for being moved about its pivot in generally the longitudinal direction of the traveling material to cause the traveling material to move transversely.

8. Apparatus, as set forth in claim 7, in which said means for aligning the thinned middle portion of the moving material in said second work station further includes means carried by said frame means and connected to said bowed guide rod means for pivotally moving said bowed guide rod means back and forth, and sensing and control means mounted on said frame means and connected with said means for moving said bowed guide rod means for sensing the longitudinal path of travel of the thinned middle portion and controlling movement of said bowed guide rod means.

9. Apparatus, as set forth in claim 8, in which said means for moving said bowed guide rod means comprises a fluid-operated double-acting piston and cylinder mechanism.

10. Apparatus, as set forth in claim 8 or 9, in which said sensing and control means comprises separate movable finger-like sensors positioned in generally side-by-side relationship for riding on the thinned middle portion generally at each of the junctures thereof with the thickened portions in the desired path of travel of the material, electrical switches respectively associated with each of said sensors for being actuated by said respective sensor when said respective sensor is moved by transverse deviation in the path of travel of the material causing the respective sensor to ride up on a thickened portion of the material, and electrical circuit means connected between said electrical switches and said bowed guide rod moving means for controlling operation of said bowed guide rod moving means in response to movement of said sensors and actuation of said electrical switches.

11. Apparatus, as set forth in claim 10, in which said splitting means comprises a rotating circular blade mounted on said frame means and positioned subsequent to said sensors and generally midway between said sensors in the longitudinal path of travel of the material, and said stitching means comprises a double-needle sewing machine mounted on said frame means for stitching each of the folded hems.

12. Apparatus, as set forth in claim 1, in which said apparatus further includes means carried by said frame means and positioned in advance of said first work station for aligning the traveling material in a desired longitudinal path of travel so that the traveling material is prealigned when fed through said first work station.

13. Apparatus, as set forth in claim 1, in which said apparatus further includes means carried by said frame means and positioned between said first and second work stations for accumulating the traveling material in a generally tensionless condition after the material is fed from said first work station, and for aligning the traveling material in the desired longitudinal path of travel, so that the traveling material is fed into said second work station without excess tension and in a generally prealigned path of travel.

14. Apparatus, as set forth in claim 13, in which said accumulating means comprises a generally vertically-oriented sinuous chute for receiving the traveling material at one end thereof and accumulating the traveling material therein prior to removal therefrom at the other end thereof as the material is fed by said feeding means.

15. Apparatus, as set forth in claim 13, in which said material aligning means includes a bowed guide rod means defining an outside convex surface and being pivotally mounted on said frame means for receiving the traveling material over said convex surface and for being moved about its pivot generally in the longitudinal direction of the traveling material to cause the traveling material to move transversely, means carried by said frame means and connected to said bowed guide rod means for pivotally moving said bowed guide rod means back and forth, and sensing and control means carried by said frame means and connected with said means for moving said bowed guide rod means for sensing the longitudinal path of travel of the material and controlling movement of said bowed guide rod means.

16. Apparatus, as set forth in claim 15, in which said means for moving said bowed guide rod means comprises a fluid-operated double-acting piston and cylinder mechanism, and said sensing and control means comprises photoelectric means positioned for sensing one longitudinal hemmed edge of the traveling material and electrical circuit means connected between said piston and cylinder mechanism and said photo-electric sensing means for controlling operation of said piston and cylinder mechanism in response to the position of the hemmed edge of the traveling material as sensed by said photo-electric means.

17. Apparatus, as set forth in claim 15 or 16, in which said material aligning means further includes stationary bowed guide rod means positioned subsequent to said pivotally movable bowed guide rod means in the path of travel of the material.

18. Apparatus for automatically guiding, trimming, splitting and side hemming continuous textile material having thickened individual portions, such as terry towels, woven therein side-by-side relationship transversely of the material and in series longitudinally of the material and being separated by a thinned portion extending longitudinally along generally the middle of the material and having thinned selvage edge portions extending along each longitudinal side edge of the material; said apparatus comprising:

frame means;

means carried by said frame means for feeding the continuous textile material from a supply through said apparatus in a generally longitudinally-extending path of travel;

a first work station having movable means positioned on each side of the traveling material for trimming each of the selvage edge portions to a predetermined width, folding hems in each of the trimmed selvage edges and stitching each of the folded hems as the material is fed through said first work station, separate carriage means movably mounted on said frame on respective sides of the traveling material and respectively carrying said trimming, folding and stitching means for individual movement transversely of the traveling material, separate means carried by said frame means and respectively connected to said carriage means for moving said carriage means back and forth transversely of the traveling material, and separate sensing and control means mounted on said frame means and respectively connected with said means for moving said carriage means for individually sensing the respective longitudinal paths of travel of the thinned selvage edges of the material and controlling movement of said respective carriage means for aligning said trimming, folding and stitching means on each side of the traveling material in proper transverse position relative to each of the respective selvage edges regardless of transverse deviation of the longitudinal paths of travel of such selvage edges as the material travels through said first work station; and a second work station positioned subsequent to said first work station in the path of travel of the material and having stationary means carried by said frame means for longitudinally splitting the material through the thinned middle portion into strips, folding hems in the thus formed longitudinally-extending cut side edges of the strips and stitching each of the folded hems, a bowed guide rod means positioned in advance of said splitting, folding and stitching means and defining an outside convex surface and being pivotally mounted on said frame means for receiving the traveling material over said convex surface and for being moved about its pivot in generally the longitudinal direction of the traveling material to cause the traveling material to move transversely, means carried by said frame means and connected to said bowed guide rod means for pivotally moving said bowed guide rod means back and forth, and sensing and control means mounted on said frame means and connected with said means for moving said bowed guide rod means for sensing the longitudinal path of travel of the thinned middle portion and controlling movement of said bowed guide rod means for aligning the thinned middle portion of the traveling material relative to said stationary splitting, folding and stitching means for splitting the material through generally the center of the thinned middle portion and forming uniform stitched hems on each cut edge.

19. Apparatus for automatically guiding, trimming, splitting and side hemming continuous textile material having thickened individual portions, such as terry towels, woven therein side-by-side relationship transversely of the material and in series longitudinally of the material and being separated by a thinned portion extending longitudinally along generally the middle of the material and having thinned selvage edge portions extending along each longitudinal side edge of the material; said apparatus comprising:

frame means;

means carried by said frame means for feeding the continuous textile material from a supply through said apparatus in a generally longitudinally-extending path of travel;

a first work station having movable means positioned on each side of the traveling material for trimming each of the selvage edge portions to a predetermined width, folding hems in each of the trimmed selvage edges and stitching each of the folded hems as the material is fed through said first work station, separate carriage means movably mounted on said frame on respective sides of the traveling material and respectively carrying said trimming, folding and stitching means for individual movement transversely of the traveling material, separate means carried by said frame means and respectively connected to said carriage means for moving said carriage means back and forth transversely of the traveling material, and separate sensing and control means mounted on said frame means and respectively connected with said means for moving said carriage means for individually sensing the respective longitudinal paths of travel of the thinned selvage edges of the material and controlling movement of said respective carriage means for aligning said trimming, folding and stitching means on each side of the traveling material in proper transverse position relative to each of the respective selvage edges regardless of transverse deviation of the longitudinal paths of travel of such selvage edges as the material travels through said first work station;

means carried by said frame means and positioned in advance of said first work station for aligning the traveling material in a longitudinal path of travel so that the traveling material is pre-aligned when fed through said first work station;

a second work station positioned subsequent to said first work station in the path of travel of the material and having stationary means carried by said frame means for longitudinally splitting the material through the thinned middle portion into strips, folding hems in the thus formed longitudinally-extending cut side edges of the strips and stitching each of the folded hems, a bowed guide rod means positioned in advance of said splitting, folding and stitching means and defining an outside convex surface and being pivotally mounted on said frame means for receiving the traveling material over said convex surface and for being moved about its pivot in generally the longitudinal direction of the traveling material to cause the traveling material to move transversely, means carried by said frame means and connected to said bowed guide rod means for pivotally moving said bowed guide rod means back and forth, and sensing and control means mounted on said frame means and connected with said means for moving said bowed guide rod means for sensing the longitudinal path of travel of the thinned middle portion and controlling movement of said bowed guide rod means for aligning the thinned middle portion of the traveling material relative to said stationary splitting, folding and stitching means for splitting the material through generally the center of the thinned middle portion and forming uniform stitched hems on each cut edge; and means carried by said frame means and positioned between said first and second work stations for accumulating the traveling material in a generally tensionless condition after the material is fed from said first work station and for aligning the traveling material in the desired longitudinal path of travel, so that the traveling material is fed into said second work station without excess tension and in a generally pre-aligned path of travel.

20. Apparatus, as set forth in claim 18 or 19, in which said carriage means in said first work station comprises a generally horizontally-positioned table-like device extending from beneath the traveling material on respective sides of the thinned middle portion and outwardly of the thinned selvage edge portions for carrying the trimming, folding and stitching means on the outwardly extending part thereof, said means for moving said carriage means comprises fluid-operated double-acting piston and cylinder mechanisms, and said sensing and control means in said first work station comprises separate movable finger-like sensors positioned in generally side-by-side relationship for respectively riding on the thinned selvage edge portion and on the adjacent thickened portion at generally the juncture between such portions in the desired path of travel of the material, electrical switches respectively associated with each of said sensors for being actuated by said respective sensor when respective sensor is moved by transverse deviation in the path of travel of the material causing the respective sensor to ride on the other of such portions of the material and electrical circuit means connected between said electrical switches and said carriage moving means for controlling operation of said carriage moving means in response to movement of said sensors and actuation of said electrical switches.

21. Apparatus, as set forth in claim 18 or 19, in which said means for moving said bowed guide rod means in said second work station comprises a fluid-operated double-acting piston and cylinder mechanism, and said sensing and control means in said second work station comprises separate movable finger-like sensors positioned in generally side-by-side relationship for riding on the thinned middle portion generally at each of the junctures thereof with the thickened portions in the desired path of travel of the material, electrical switches respectively associated with each of said sensors for being actuated by said respective sensor when said respective sensor is moved by transverse deviation in the path of travel of the material causing the respective sensor to ride up on a thickened portion of the traveling material and electrical circuit means connected between said electrical switches and said piston and cyclinder mechanism for controlling operation of said piston and cyclinder mechanism in response to movement of said sensors and actuation of said electrical switches.

22. Apparatus, as set forth in claim 18 or 19, in which said splitting means in said second work station comprises a rotating circular blade mounted on said frame means and positioned subsequent to said sensors and generally mid-way between said sensors in the longitudinal path of travel of the material, and said stitching means in said second work station comprises a double-needle sewing machine mounted on said frame means for stitching each of the folded hems.

23. Apparatus, as set forth in claim 19, in which said accumulating means positioned between said first and second work stations comprises a generally vertically-oriented sinuous chute for receiving the traveling material at one end thereof and accumulating the traveling material therein prior to removal therefrom at the other end thereof as the material is fed by said feeding means, and said material aligning means positioned between said first and second work stations comprises a bowed guide rod means defining an outside convex surface and being pivotally mounted on said frame means for receiving the traveling material over said convex surface and for being moved about its pivot generally in the longitudinal direction of the traveling material to cause the traveling material to move transversely, a fluid-operated double-acting piston and cylinder mechanism carried by said frame means and connected to said bowed guide rod means for pivotally moving said bowed guide rod means back and forth, photo-electric means positioned for sensing one longitudinal edge of the traveling material and electrical circuit means connected between said piston and cylinder mechanism and said photo-electric sensing means for controlling operation of said piston and cylinder mechanism in response to the position of the hemmed edge of traveling material as sensed by said photo-electric means for controlling movement of said bowed guide rod means.

24. Apparatus, as set forth in claim 23, in which said material aligning means positioned between said first and second work stations further includes stationary bowed guide rod means positioned subsequent to said pivotally movable bowed guide rod means in the path of travel of the material.

25. Apparatus for automatically guiding, splitting and hemming the cut edges of continuous textile material having thickened individual portions, such as terry towels, woven therein in side-by-side relationship transversely of the material and in series longitudinally of the material and being separated by a thinned portion extending longitudinally along generally the middle of the material said apparatus comprising:

frame means;

means carried by said frame means for feeding the continuous textile material through said apparatus in a generally longitudinally-extending path of travel;

means mounted in a stationary position on said frame means for longitudinally splitting the material through the thinned middle portion into strips;

means mounted in a stationary position on said frame means for folding hems in the thus formed longitudinally-extending cut side edges of the strips;

means mounted in a stationary position on said frame means for stitching each of the folded hems;

a bowed guide rod means positioned in advance of said splitting, folding and stitching means in the path of travel of the material and defining an outside convex surface and being pivotally mounted on said frame means for receiving the traveling material over said convex surface and for being moved about its pivot in generally the longitudinal direction of the traveling material to cause the traveling material to move transversely;

means carried by said frame means and connected to said bowed guide rod means for pivotally moving said bowed guide rod means back and forth; and sensing and control means mounted onto said frame means and connected with said means for moving said bowed guide rod means for sensing the longitudinal path of travel of the thinned middle portion of the material and controlling movement of said bowed guide rod means for aligning the thinned middle portion of the traveling material relative to said stationary splitting, folding and stitching means for splitting the material through generally the center of the thinned middle portion and forming uniform stitched hems on each cut edge.

26. Apparatus, as set forth in claim 25, in which said means for moving said bowed guide rod means comprises a fluid-operated double-acting piston and cylinder mechanism.

27. Apparatus, as set forth in claim 25, in which said sensing and control means comprises separate movable fingerlike sensors positioned in generally side-by-side relationship for riding on the thinned middle portion generally at each of the junctures thereof with the thickened portions in the desired path of travel of the material, electrical switches respectively associated with each of said sensors for being actuated by said respective sensor when said respective sensor is moved by transverse deviation in the path of travel of the material causing the respective sensor to ride up on a thickened portion of the material, and electrical circuit means connected between said electrical switches and said bowed guide rod moving means for controlling operation of said bowed guide rod moving means in response to movement of said sensors and actuation of said electrical switches.

28. Apparatus, as set forth in claim 25, in which said splitting means comprises a rotating circular blade and said stitching means comprises a double-needle sewing machine for stitching each of the folded hems.

29. Apparatus for automatically guiding, splitting and hemming the cut edges of continuous textile material having thickened individual portions, such as terry towels, woven therein in side-by-side relationship transversely of the material and in series longitudinally of the material and being separated by a thinned portion extending longitudinally along generally the middle of the material; said apparatus comprising:

frame means;

means carried by said frame means for feeding the continuous textile material through said apparatus in a generally longitudinally extending path of travel;

rotating circular blade means mounted in a stationary position on said frame for longitudinally splitting the material through the thinned middle portion into strips;

means mounted in a stationary position on said frame means for folding hems in the thus formed longitudinally-extending cut side edges of the strips;

a double-needle sewing machine mounted in a stationary position on said frame means for stitching each of the folded hems;

a bowed guide rod means positioned in advance of said splitting, folding and stitching means in the path of travel of the material and defining an outside convex surface and being pivotally mounted on said frame means for receiving the traveling material over said convex surface and for being moved about its pivot in generally the longitudinal direction of the traveling material to cause the traveling material to move transversely;

fluid-operated double-acting piston and cylinder mechanism carried by said frame means and connected to said bowed guide rod means for pivotally moving said bowed guide rod means back and forth; and sensing and control means mounted on said frame means and connected with said piston and cylinder means for sensing the longitudinal path of travel of the thinned middle portion of the material and controlling movement of said bowed guide rod means for aligning the thinned middle portion of the traveling material relative to said stationary splitting, folding and stitching means for splitting the material through generally the center of the thinned middle portion and forming uniform stitched hems on each cut edge, said sensing and control means comprising separate movable finger-like sensors positioned in generally side-by-side relationship for riding on the thinned middle portion generally at each of the junctures thereof with the thickened portions in the desired path of travel of the material, electrical switches respectively associated with each of said sensors for being actuated by said respective sensors when said respective sensor is moved by transverse deviation in the path of travel of the material causing the respective sensor to ride up on a thickened portion of the material, and electrical circuit means connected between said electrical switches and said piston and cylinder mechanism for controlling operation of said piston and cylinder mechanism in response to movement of said sensors and actuation of said electrical switches.

30. Method for automatically guiding, trimming, splitting and side hemming continuous textile material having thickened individual portions, such as terry towels, woven therein in side-by-side relationship transversely of the material and in series longitudinally of the material and being separated by a thinned portion extending longitudinally along generally the middle portion of the material and having thinned selvage edge portions extending along each longitudinal side edge of the material; said method comprising the steps of:

feeding the continuous material from a supply through an automatically operating apparatus;

trimming each of the selvage edge portions of the traveling material to a predetermined width, folding hems in each of the trimmed selvage edges and stitching each of the folded hems with mechanisms in a first work station of the apparatus while the material is fed through the first work station in the apparatus;

individually moving and aligning the mechanisms for trimming, folding and stitching on each side of the traveling material in proper transverse positions relative to each of the selvage edges regardless of transverse deviation in the longitudinal paths of travel of such selvage edges as the material travels through the first work station;

longitudinally splitting the material through the thinned middle portion into strips, folding hems in the thus formed longitudinally-extending cut side edges of the strips and stitching each of the folded hems with mechanisms in a second work station in the apparatus; and aligning the thinned middle portion of the traveling material relative to the splitting, folding and stitching mechanisms for splitting the material generally through the center of the thinned middle portion and forming uniform stitched hems on each cut edge as the material travels through the second work station.

31. Method, as set forth in claim 30, in which said step of individually moving and aligning the mechanisms for trimming, folding and stitching on each side of the traveling material includes individually sensing the respective longitudinal paths of travel of each of the thinned selvage edges of the material and controlling the moving and aligning of the mechanisms in response to the sensed paths of travel.

32. Method, as set forth in claim 30, in which said step of aligning the thinned middle portion of the traveling material relative to the splitting, folding and stitching mechanisms includes passing the traveling material over an outside convex surface of a pivotally mounted bowed guide rod and moving the guide rod about its pivot generally in the longitudinal direction of the traveling material to cause the traveling material to move transversely back and forth for the aligning thereof.

33. Method, as set forth in claim 30 or 32, in which said step of aligning the thinned middle portion of the traveling material relative to the splitting, folding and stitching mechanism includes sensing the longitudinal path of travel of the thinned middle portion and controlling the aligning of the thinned middle portion of the traveling material in response to the sensed path of travel.

34. Method, as set forth in claim 30, further including the step of pre-aligning the traveling material in advance of the travel thereof through the first work station for aiding in individually moving and aligning the mechanisms for trimming, folding and stitching on each side of the traveling material.

35. Method, as set forth in claim 30, further including the steps of accumulating the traveling material in a generally tensionless condition and aligning the traveling material in a desired longitudinal path of travel as the material travels between the first and second work stations and prior to aligning the thinned middle portion of the traveling material relative to the splitting, folding and stitching mechanisms in the second work station.

36. Method for automatically guiding, trimming, splitting and side hemming continuous textile material having thickened individual portions, such as terry towels, woven therein in side-by-side relationship transversely of the material and in series longitudinally of the material and being separated by a thinned middle portion extending longitudinally along generally the middle of the material and having thinned selvage edge portions extending along each longitudinal side edge of the material; said method comprising the steps of:

feeding the continuous material from a supply through an automatically operating apparatus;

trimming each of the selvage edge portions of the traveling material to a predetermined width, folding hems in each of the trimmed selvage edges and stitching each of the folded hems with mechanisms in a first work station of the apparatus while the material is fed through the first work station in the apparatus;

individually moving and aligning the mechanisms for trimming, folding and stitching on each side of the traveling material in proper transverse positions relative to each of the selvage edges regardless of transverse deviation in the longitudinal paths of travel of such selvage edges as the material travels through the first work station and including individually sensing the respective longitudinal paths of travel of each of the thinned selvage edges of the material and controlling the moving and aligning of the mechanisms in response to the sensed paths of travel;

longitudinally splitting the material through the thinned middle portion into strips, folding hems in the thus formed longitudinally-extending cut side edges of the strips and stitching each of the folded hems with mechanisms in a second work station in the apparatus; and aligning the thinned middle portion of the traveling material relative to the splitting, folding and stitching mechanisms for splitting the material generally through the center of the thinned middle portion and forming uniform stitched hems on each cut edge as the material travels through the second work station and including passing the traveling material over an outside convex surface of a pivotally-mounted bowed guide rod and moving the guide rod about its pivot generally in the longitudinal direction of the traveling web to cause the material to move transversely back and forth for the aligning thereof and sensing the longitudinal path of travel of the thinned middle portion and controlling movement of the guide rod in response to the sensed path of travel.

37. Method for automatically guiding, trimming, splitting and side hemming continuous textile material having thickened individual portions, such as terry towels, woven therein in side-by-side relationship transversely of the material and in series longitudinally of the material and being separated by a thinned portion extending longitudinally along generally the middle of the material and having thinned selvage edge portions extending along each longitudinal side edge of the material; said method comprising the steps of:

feeding the continuous material from a supply through an automatically operating apparatus;

trimming each of the selvage edge portions of the traveling material to a predetermined width, folding hems in each of the trimmed selvage edges and stitching each of the folded hems with mechanisms in a first work station of the apparatus while the material is fed through the first work station in the apparatus;

individually moving and aligning the mechanisms for trimming, folding and stitching on each side of the traveling material in proper transverse positions relative to each of the selvage edges regardless of transverse deviation in the longitudinal paths of travel of such selvage edges as the material travels through the first work station and including longitudinally sensing the respective longitudinal paths of travel of each of the thinned selvage edges of the material and controlling the moving and aligning of the mechanisms in response to the sensed paths of travel;

pre-aligning the traveling material in advance of the travel thereof through the work station for aiding in individually moving and aligning the mechanisms for trimming, folding and stitching on each side of the traveling material;

longitudinally splitting the material through the thinned middle portion into strips, folding hems in the thus formed longitudinally-extending cut side edges of the strips and stitching each of the folded hems with mechanisms in a second work station in the apparatus;

aligning the thinned middle portion of the traveling material relative to the splitting, folding and stitching mechanisms for splitting the material generally through the center of the thinned middle portion and forming uniform stitched hems on each cut edge as the material travels through the second work station and including passing the traveling material over an outside convex surface of a pivotally-mounted bowed guide rod and moving the guide rod about is pivot generally in the longitudinal direction of the traveling web to cause the material to move transversely back and forth for the aligning thereof and sensing the longitudinal path of travel of the thinned middle portion and controlling movement of the guide rod in response to the sensed path of travel; and accumulating the traveling material in a generally tensionless condition and aligning the traveling material in a desired longitudinal path as the material travels between the first and second work stations and prior to aligning the thinned middle portion of the traveling material relative to the splitting, folding and stitching mechanisms in the second work station.

* * * * *

UNITED STATES PATENT AND TRADEMARK OFFICE

CERTIFICATE OF CORRECTION

PATENT NO. : 4,589,361

DATED : May 20, 1986

INVENTOR(S) : Dennis L. Starnes; William G. Kimball; David K. Keziah

It is certified that error appears in the above-identified patent and that said Letters Patent is hereby corrected as shown below:

Column 4, line 29, after the word "selvage" insert -- edge --.

Column 4, line 47, "malchine" should be -- machine --.

Column 5, line 9, after the word "selvage" insert -- edge --.

Column 6, line 18, "ar" should be -- are --.

Column 8, line 1, "described" should be -- desired --.

Column 18, line 55, delete "middle".

Column 20, lines 9 and 10, delete "longitudinally" and insert -- individually --.

Column 20, line 16, after "through the" insert -- first --.

Signed and Sealed this

Ninth Day of September 1986

[SEAL]

Attest:

DONALD J. QUIGG

Attesting Officer

Commissioner of Patents and Trademarks